US011497381B2

(12) United States Patent
Boyer et al.

(10) Patent No.: US 11,497,381 B2
(45) Date of Patent: Nov. 15, 2022

(54) BASKET FOR A DISH WASHING APPLIANCE

(71) Applicant: Midea Group Co., Ltd., Foshan (CN)

(72) Inventors: Joel Boyer, Louisville, KY (US); Robert Digman, Goshen, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 129 days.

(21) Appl. No.: 16/556,855

(22) Filed: Aug. 30, 2019

(65) Prior Publication Data

US 2021/0059499 A1 Mar. 4, 2021

(51) Int. Cl.
*A47L 15/50* (2006.01)

(52) U.S. Cl.
CPC ..... *A47L 15/501* (2013.01); *A47L 15/502* (2013.01); *A47L 15/507* (2013.01)

(58) Field of Classification Search
CPC . A47L 15/50–508; A47B 46/00; A47B 55/02; A47B 53/00–02; A47B 81/02–04; A47B 45/00; A47B 88/407; A47B 88/40; A47B 88/443; A47B 88/447; A47B 88/45; A47B 2088/401; A47B 2210/0078; A47B 2210/0083
See application file for complete search history.

(56) References Cited

U.S. PATENT DOCUMENTS 3,269,548 A * 8/1966 Geiger ..... A47L 15/507 312/334.13
3,466,109 A * 9/1969 Kauffman ..... A47L 15/507 312/228.1
3,768,883 A * 10/1973 Kauffman ..... A47B 88/407 312/351
4,097,099 A * 6/1978 Spiegel ..... A47L 15/504 312/351
7,909,181 B2 3/2011 Purushothaman
8,858,725 B2 * 10/2014 Mailander ..... A47L 15/502 211/41.8
9,173,544 B2 11/2015 Ayvazoglu et al.
9,226,643 B2 1/2016 Garnett et al.
9,516,991 B2 12/2016 Aro
2003/0209548 A1 * 11/2003 Phifer ..... A47L 15/502 220/486
2003/0226580 A1 * 12/2003 Welch ..... A47L 15/504 134/201

(Continued)

FOREIGN PATENT DOCUMENTS

DE 9216495 U1 3/1994
DE 19726553 A1 1/1998

(Continued)

*Primary Examiner* — Spencer E. Bell
*Assistant Examiner* — Omair Chaudhri
(74) *Attorney, Agent, or Firm* — Middleton Reutlinger

(57) ABSTRACT

A basket for an appliance such as a dish washing appliance. A rack may be positionable between a stowed position and a deployed position. The rack may include a secondary rack positionable between a stowed position and a deployed position relative to the rack. The secondary rack may include the basket. The basket may be positionable to one or more walls of the dishwasher tub between a stowed position and a deployed position. The basket may be removable from one or more racks and/or the one or more walls of the dishwasher tub.

20 Claims, 6 Drawing Sheets

(56) References Cited

U.S. PATENT DOCUMENTS

2005/0133063 A1* 6/2005 Welch ..... A47L 15/50 134/135
2006/0219271 A1* 10/2006 Feddema ..... A47L 15/502 134/56 D
2006/0289041 A1* 12/2006 Woo ..... A47L 15/502 134/201
2008/0093314 A1* 4/2008 Classen ..... A47L 15/503 211/41.8
2009/0038657 A1* 2/2009 Kang ..... A47L 15/502 211/41.9
2009/0058248 A1* 3/2009 Gossens ..... A47B 96/061 211/90.02
2009/0140619 A1* 6/2009 Buehlmeyer ..... A47L 15/502 312/228.1
2010/0314977 A1* 12/2010 Mallory ..... A47L 15/504 312/228.1
2013/0180202 A1* 7/2013 Woods ..... E04F 19/062 52/710
2016/0007824 A1* 1/2016 Maier ..... A47L 15/501 211/41.8
2016/0128543 A1 5/2016 Alwin
2017/0224189 A1* 8/2017 Kulkarni ..... A47L 15/505
2017/0332878 A1* 11/2017 Isbilen ..... A47L 15/503
2018/0220867 A1* 8/2018 Carr ..... A47L 15/50

FOREIGN PATENT DOCUMENTS

DE 102013013649 A1 * 2/2015 ..... A47L 15/507
DE 102014208843 A1 11/2015
EP 0385877 B1 9/1990
EP 1262140 A1 12/2002
FR 2958145 A1 * 10/2011 ..... A47L 15/507
WO WO2017176286 A1 10/2017
WO WO-2018188879 A1 * 10/2018 ..... A47L 15/50

* cited by examiner

BASKET FOR A DISH WASHING APPLIANCE

BACKGROUND

The present embodiments relate to a basket for a dishwasher appliance, particularly a silverware basket.

Typical silverware baskets may be placed within the appliance rack, drawer, or shelf. However, this practice may often include cumbersome repositioning of the appliance rack that may be weighted from other items to be cleaned to access the silverware basket. Thus, there is a need for a basket and/or portions of the dishwasher rack to be easily accessible to unload and/or load items (e.g. silverware, etc.) within a dishwasher tub.

SUMMARY

In some embodiments of the invention, for example, a dish washing appliance may include a dishwasher tub, a first rack, a first slide mechanism, a second rack, and/or a second slide mechanism. In various embodiments, the first slide mechanism may connect the first rack to the dishwasher tub, wherein the first rack may be positionable between a first stowed position in the dishwasher tub and a first deployed position, wherein the first deployed position is different from the first stowed position. In some embodiments, the second rack may include one or more baskets. Moreover, in various embodiments, the second slide mechanism may connect the second rack to the first rack, wherein the one or more baskets and the second rack may be positionable between a second stowed position in the first rack and a second deployed position, wherein the second deployed position is different from the second stowed position.

In various embodiments, at least one of the first slide mechanism and the second slide mechanism may be one or more slides. In some embodiments, the one or more baskets may be removeably mounted to the second rack. In addition, in various embodiments, wherein in the second stowed position, the second rack may be positioned within an outer periphery of the first rack. In some embodiments, when the first rack is in at least the first stowed position, the second rack may be in the second deployed position. In various embodiments, when the first rack is in at least the first deployed position, the second rack may be in at least one of the second deployed position and the second stowed position relative to the first rack. Moreover, in some embodiments, the one or more baskets may be a silverware basket.

In some embodiments, a dishwasher rack for a dish washing appliance may include a first wire rack, a second wire rack, and/or a slide mechanism. In various embodiments, the first wire rack may be positionable in a first stowed position in the dish washing appliance. In some embodiments, the second wire rack may be disposed in the first wire rack in a second stowed position. In addition, in some embodiments, the slide mechanism connecting the second wire rack to the first wire rack may allow the second wire rack to translate from the second stowed position with the first wire rack.

In various embodiments, the first wire rack may include a second slide mechanism. In some embodiments, the dishwasher rack may include a silverware basket removably mounted in the second wire rack. Moreover, in various embodiments, the second wire rack may include a second deployed position different from the second stowed position, wherein the second wire rack may be in the second deployed position in at least the first stowed position of the first wire rack. In some embodiments, when in the second stowed position, the second wire rack may be disposed within an outer periphery of the first wire rack. In various embodiments, when in the second stowed position, the second wire rack may extend from a front side to a back side of the first wire rack. In addition, in various embodiments, the second wire rack may pass through the front side of the first wire rack from the second stowed position. In some embodiments, the slide mechanism may include one or more slides.

In addition, in various embodiments, a dish washing appliance may include a dishwasher tub, a first rack, a second rack, and/or a slide mechanism. In some embodiments, the first rack may be positionable between a first stowed position in the dishwasher tub and a first deployed position, wherein the first deployed position is different from the first stowed position. Moreover, in various embodiments, the second rack may be carried with the first rack between the first stowed position and the first deployed position. In addition, in some embodiments, the slide mechanism may connect the second rack to the first rack, wherein the second rack may be positionable between a second stowed position in the first rack and a second deployed position, wherein when in the second deployed position the second rack projects outwardly and away from the first rack.

In various embodiments, the second rack may project from a front side of the first rack when the second rack is in the second deployed position. In some embodiments, when the first rack is in at least the first stowed position, the second rack may be in the second deployed position. In various embodiments, when the first rack is in at least the first deployed position, the second rack may be in the second deployed position relative to the first rack. Moreover, in some embodiments, the dish washing appliance may include a second slide mechanism connecting the first rack and the dishwasher tub. In addition, in various embodiments, the first rack may travel in a first direction between the first stowed position and the first deployed position and the second rack may travel in a second direction between the second stowed position and the second deployed position, and the first direction may be the same as the second direction.

These and other advantages and features, which characterize the embodiments, are set forth in the claims annexed hereto and form a further part hereof. However, for a better understanding of the embodiments, and of the advantages and objectives attained through its use, reference should be made to the drawings and to the accompanying descriptive matter, in which there are described example embodiments. This summary is merely provided to introduce a selection of concepts that are further described below in the detailed description, and is not intended to identify key or essential features of the claimed subject matter, nor is it intended to be used to limit the scope of the claimed subject matter, nor to define the field of endeavor.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
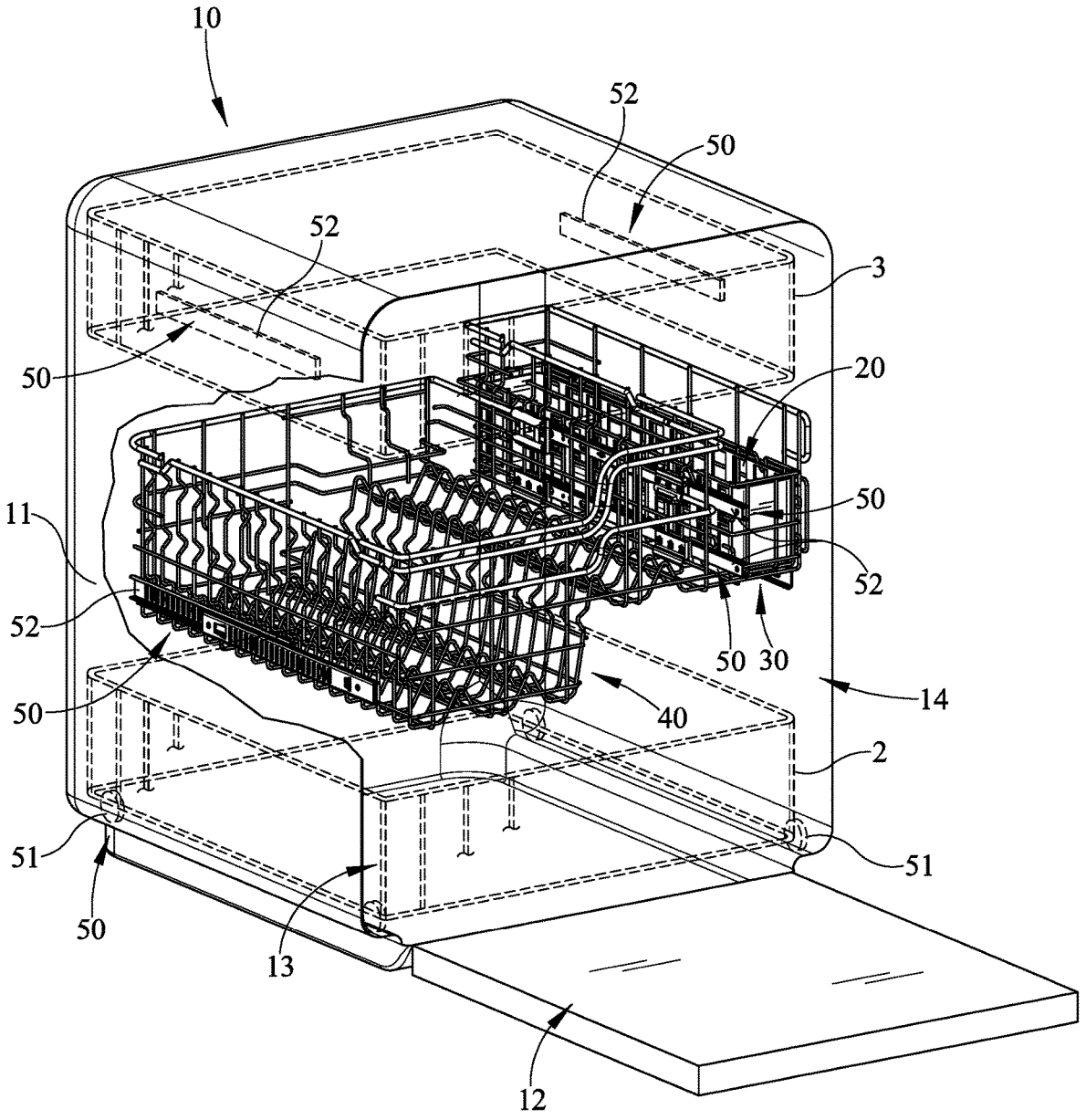
FIG. 1 is a perspective view of one embodiment of both a first dishwasher rack and second dishwasher rack in a stowed position, with portions of the housing broken away.

Numerous variations and modifications will be apparent to one of ordinary skill in the art, as will become apparent from the description below. Therefore, the invention is not limited to the specific implementations discussed herein.

The embodiments discussed hereinafter will focus on the implementation of the hereinafter-described apparatus and techniques within a front-load residential dish washing machine such as dish washing appliance 10, such as the type that may be used in single-family or multi-family dwellings, or in other similar applications. However, it will be appreciated that the herein-described apparatus and techniques may also be used in connection with other types of dish washing machines in some embodiments. For example, the herein-described apparatus and techniques may be used in commercial applications in some embodiments. Moreover, the herein-described apparatus and techniques may be used in connection with other appliances, such as, for example, ovens, refrigerators, and the like. For example, one or more drawers for a bottom mount freezer of a refrigerator appliance may include the apparatus and techniques.

Embodiments for a dish washing machine are shown herein for ease of understanding. For example, a front-load dish washing machine that includes a front-mounted door 12 in a cabinet or housing 11 that provides access to one or more horizontally-oriented dishwasher racks or assemblies 2, 3, 30, 40 housed within the cabinet or housing 11 may be used. More specifically, the dishwasher rack 2, 3, 30, 40 may be housed in a dishwasher tub 14. Implementation of the herein-described apparatus and techniques within a variety of appliances would be well within the abilities of one of ordinary skill in the art having the benefit of the instant disclosure, so the invention is not limited to the front-load dish washing implementation discussed further herein. For example, the apparatus and techniques may be used with a dishwasher drawer of a dishwashing appliance.

Turning now to the drawings, wherein like numbers denote like parts throughout the several views, FIGS. 1-6 illustrates an example dish washing appliance 10 in which the various technologies and techniques described herein may be implemented. Dish washing appliance 10 is a front-load dish washing machine, and as such may include a front-mounted door 12 defining an opening 13 that provides access to a horizontally-oriented dishwasher tub 14. The door 12 may be coupled with a cabinet or housing 11 that may house the dishwasher tub 14 in some embodiments. Door 12 is generally hinged along a front or front edge of the housing 11 adjacent the opening 13 and is pivotable between the open position illustrated in FIG. 1 and a closed position (not shown). When door 12 is in the open position, dishes, utensils, pans, and other washable items may be inserted into and removed from the one or more dishwasher racks 2, 3, 30, 40 and/or baskets 20, 120 through the opening 13 in the front of cabinet or housing 11. Control over dish washing appliance 10 by a user is generally managed through a control panel disposed on a door 12 and implementing a user interface (not shown), and it will be appreciated that in different dish washing machine designs, control panel may include various types of input and/or output devices, including various knobs, buttons, lights, switches, textual and/or graphical displays, touch screens, etc. through which a user may configure one or more settings and start and stop the dishwasher rack cycle or movement (e.g. automatic and/or manual) as described herein. For example, the control panel, or portions thereof, may be included with the dishwasher rack, on the interior or exterior of the door, and/or adjacent the rack within the opening of the dish washing machine. For example in some embodiments, portions of the controls may be accessible when the door is in the open position. In other embodiments, the one or more racks or portions thereof may close/open, lock, and/or unlock from a position by proximity of one or more users and/or by a one or more gestures/forces or bodily movement relative to the rack and/or portions of the dish washing machine.

Figure 2:
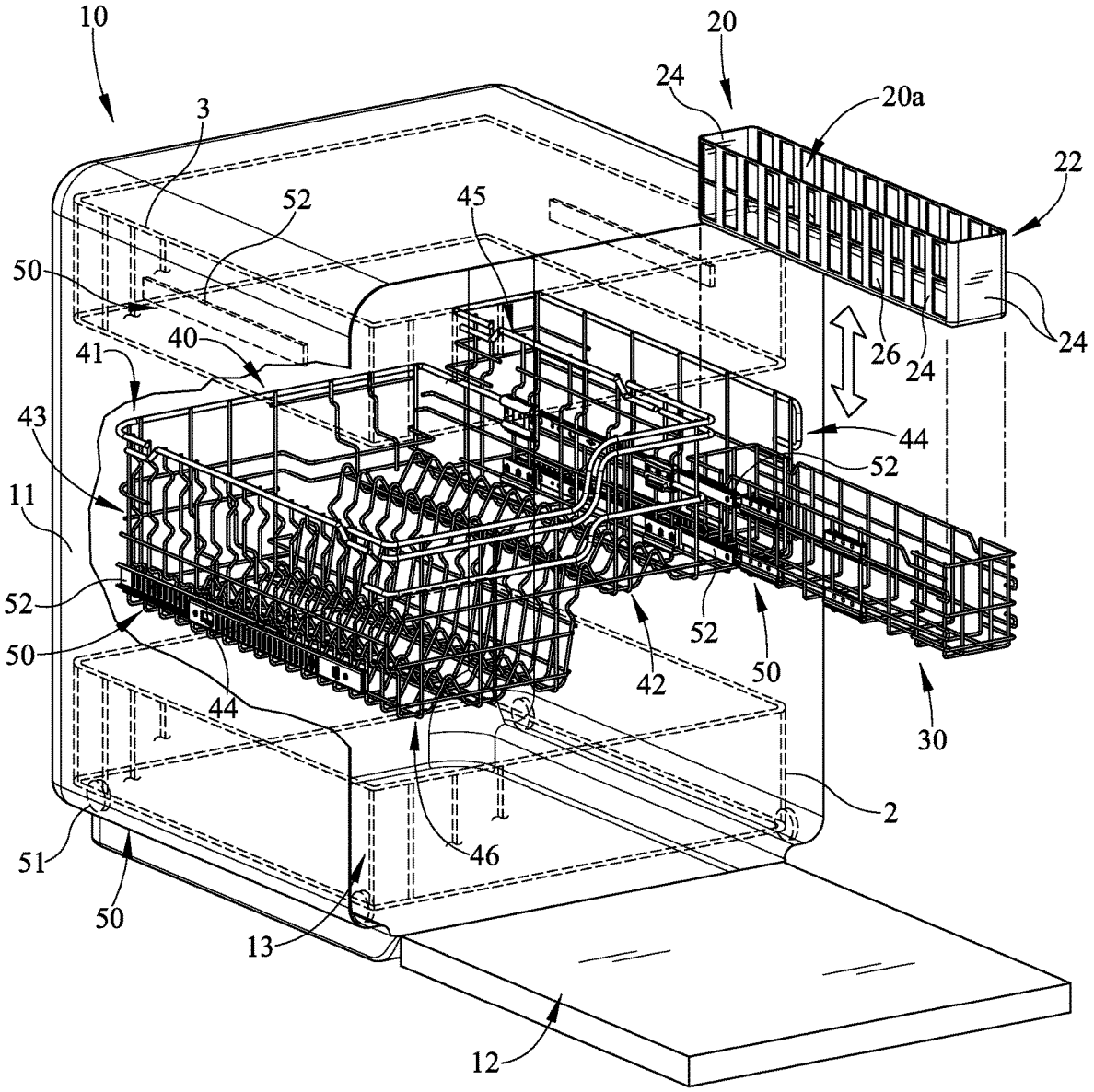
FIG. 2 is a perspective view of the embodiment of a first dishwasher rack in the stowed position of FIG. 1 with the second dishwasher rack in a deployed position, and illustrating the basket or portions of the second dishwasher rack removed.
Figure 4:
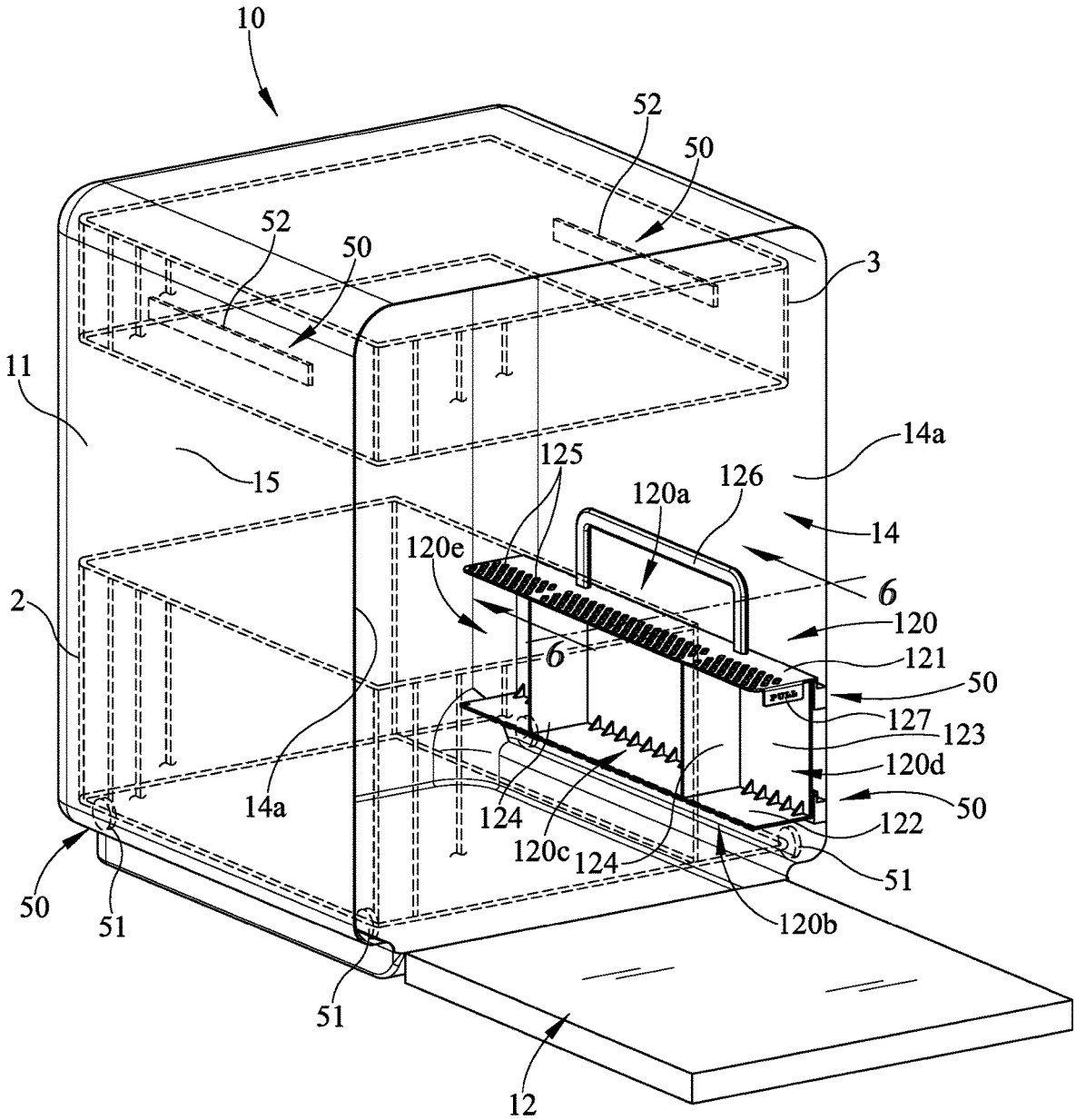
FIG. 4 is a perspective view of another embodiment of a dish washing appliance with an embodiment of a basket and rack in a stowed position.
Figure 5A:
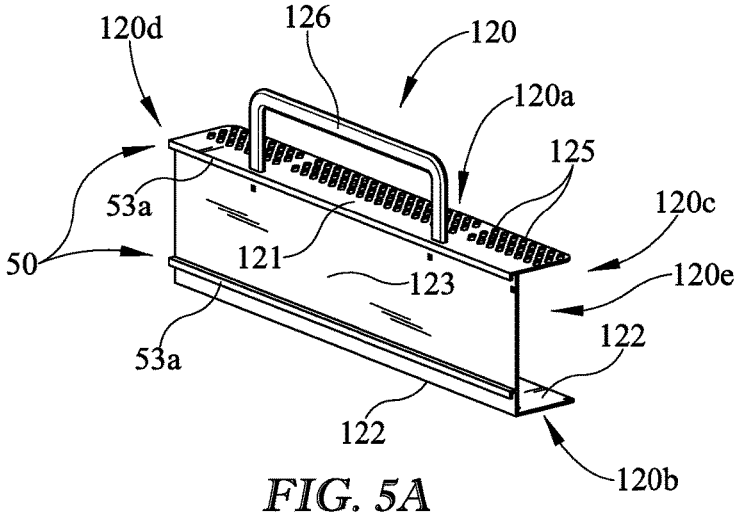
FIG. 5A is another perspective view of the basket of FIG. 4.
Figure 5:
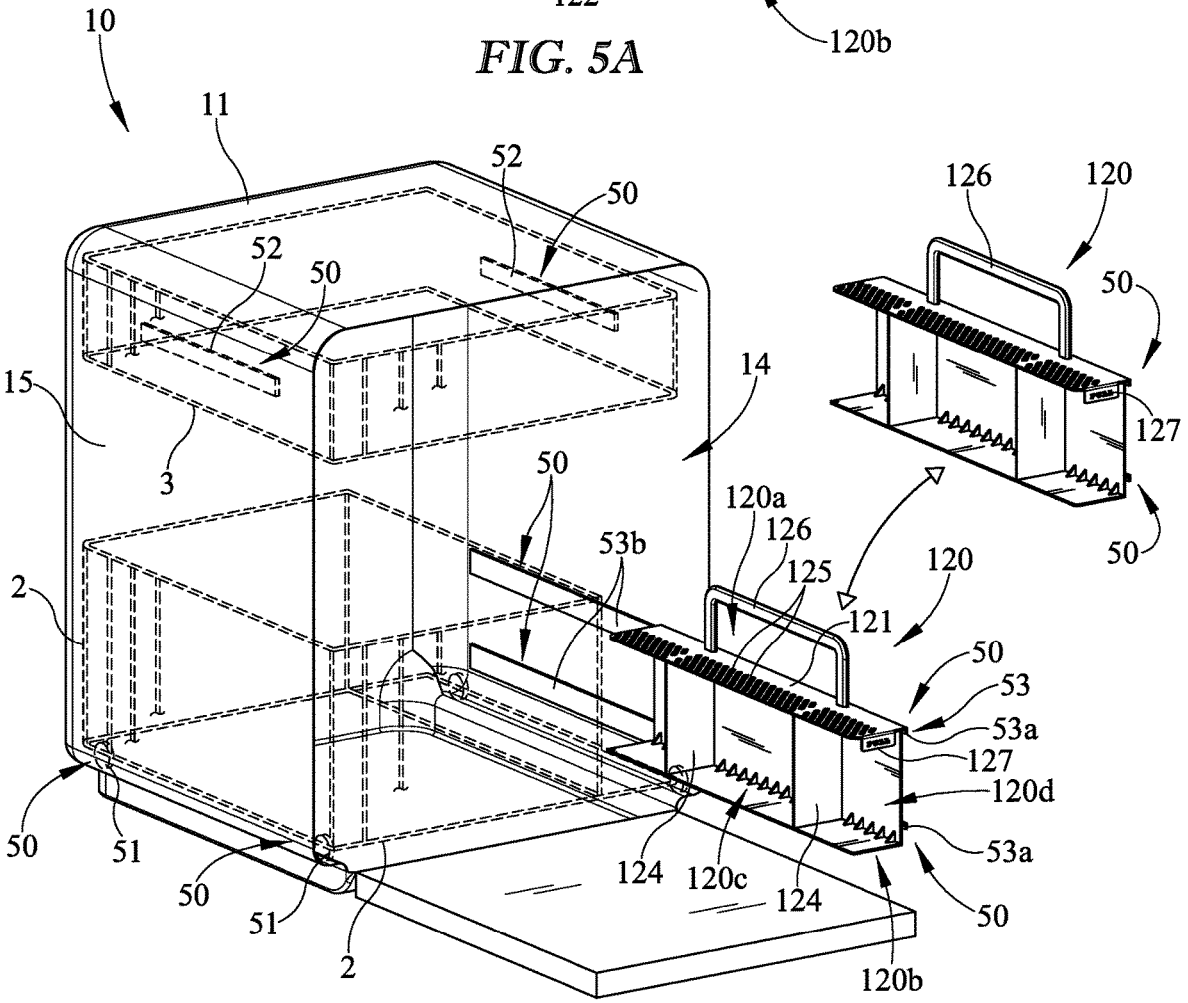
FIG. 5 is a perspective view of the dish washing appliance of FIG. 4 with the basket in the deployed position, and illustrating the basket removed.

As shown in the figures, the one or more baskets 20, 120 (e.g. silverware) and/or dishwasher racks 30, 40, or portions thereof, may be positionable relative to the dish washing appliance 10, rack, or dishwasher tub 14 between a stowed or un-deployed position (illustrated in FIGS. 1 and 4) and a deployed or different position (illustrated in FIGS. 2 and 5). At least one of the stowed positions of the dishwasher racks 30, 40 and baskets 20, 120 may be used when one or more of the washing cycles is in operation. In use, the deployed position may be one or more horizontal positions different from one or more of the stowed positions. For example in one embodiment, one deployed position or partially opened position may be a position other than when the rack 30, 40 is in its fully extending position out of the dishwasher tub 14. One or more deployed positions may be a horizontal position to dry, load, and/or unload dishes, utensils, or the like. The one or more dishwasher racks 30, 40 and/or baskets 20, 120 may travel in a substantially horizontal plane. The horizontal plane may be into and/or out of the rack or dishwasher tub 14 or cavity. Although the substantially linear movement of the dishwasher rack 30, 40 and/or basket 20, 120 cycle may occur along the horizontal plane as shown, the linear travel may be in a variety of angles and/or heights in one or both the directions into or out of a position.

Figure 3:
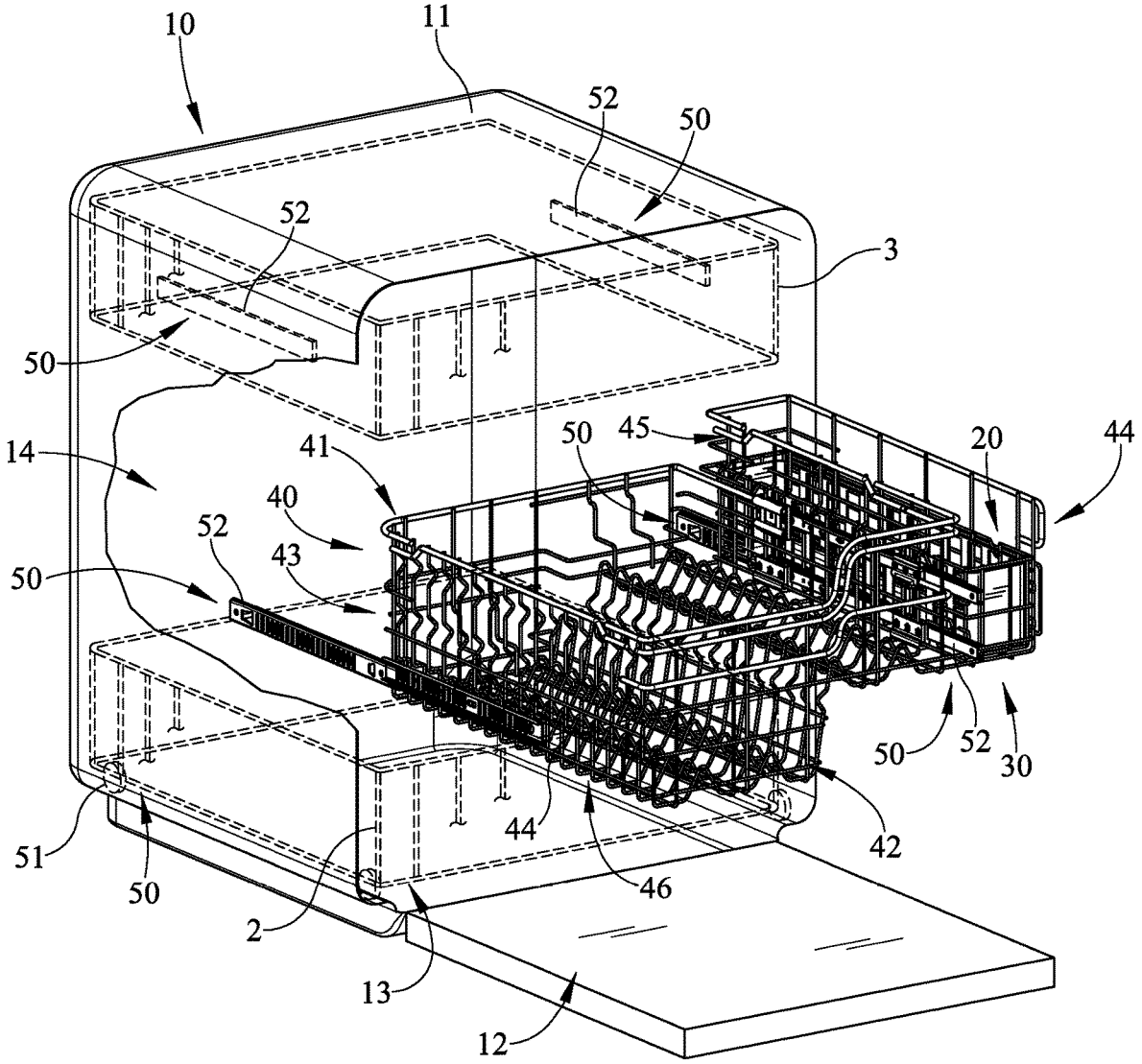
FIG. 3 is a perspective view of one embodiment of the first dishwasher rack in the deployed position and the second dishwasher rack in the stowed position.

As illustrated in the FIGS. 1-3, the basket 20 and/or dishwasher rack 30 (e.g. second rack) may be stowed or carried by the dishwasher rack 40 (e.g. first rack) between a stowed and deployed positions. The basket 20/rack 30 may be deployed away from its stowed position with the rack 40. The basket 20 and/or rack 30 may be deployed/stowed relative to the dishwasher rack 40. For example, the rack 30 and/or basket 20 may be deployed from the stowed position and/or the deployed position of the rack 40. In the stowed position as shown in FIG. 1, the rack 30 and/or basket 20 may be positioned at least partially within the rack 40 or outer periphery 41 of the rack. In the deployed position as shown in FIG. 2, the rack 30 and/or basket 20 may project outwardly and away from the rack 40. The rack 30 and/or basket 20 may be deployed from a front side or end 42 of the rack 40. The rack 30/basket 20 may project from or pass through the front side 42 of the rack 40 when the rack 40 is in its stowed or deployed position. Although the racks 30, 40/baskets 20, 120 are shown to travel in the same direction in the one embodiment shown, they may deploy/stowed in different directions. Although the stowed rack 30 and/or basket 20 may take up at least portion of the volume of the rack 40, it is shown in the one embodiment extending from the front side 42 to a back side 43 of the rack 40 when in the stowed position. Moreover, the basket 20 may be positioned within at least a portion of the volume of the rack 30 when in the stowed position. The basket 20 may be removable from the rack 30, 40 as shown in FIG. 2.

It should be understood that the basket 20, 120, if used, may be a variety of shapes, sizes, quantities, positions (e.g. stowed and deployed) relative to the tub 14 and/or racks 2, 3, and/or 30/40, and constructions and still be within the scope of the invention. Although one embodiment of the basket 20 is shown in FIGS. 1-3, the basket 20 may be a silverware basket that includes a container body 22 including multiple side walls 24 (e.g., four side walls), a bottom wall 26, and one or more interior walls (not shown), which collectively define one or more compartments 20*a* (e.g. one to six compartments) for retaining utensils. Additional components, e.g., one or more handles, not shown, may also be disposed on the silverware basket 20. Silverware basket 20 may be formed of injection molded plastic, coated metal wire, or using other constructions known to those of ordinary skill having the benefit of the instant disclosure. Further, it will be appreciated that any number of compartments, including a single compartment as shown, may be provided in the silverware basket in other implementations, so the invention is not limited to the particular configurations illustrated herein. For example, as shown, the silverware basket 20 may be removeably attached/mounted to the dishwasher rack 30. In other embodiments, the silverware basket 20 may be fixed with the rack 30. Moreover, in some embodiments, the basket or container may be used to retain silverware, drinkware articles, and other containers including cups, glasses, stemware, baby bottles, etc. Further, for example, the one or more baskets may be one or more hinged/pivoting lids or members coupled to the rack 30 to retain flatware connected to the rack and pivoting relative to the rack between one or more positions.

The one or more racks or assemblies 30, 40 may be a variety of shapes, sizes, quantities, constructions, and positions within the dish washing appliance. The rack may include an appliance rack, drawer, or shelf, with particular embodiments shown for a dishwasher rack for a dishwasher appliance. When door 12 is in the opened position, access is provided to one or more sliding racks, e.g., lower rack 2, middle or first rack 40, second rack 30, and/or upper rack 3 and are configured for receipt of various baskets/utensils for cleaning/washing. A lower rack 2 may be supported on rollers 51, while upper and/or middle racks may be supported on side or slide rails 52 (e.g. a variety of slide mechanisms 50). The one or more racks may be movable between loading/deploying (extended) and washing/stowed (retracted) positions along a substantially horizontal direction. As shown in FIGS. 1-6, the dishwasher racks 2, 3, 30, 40 may be a wire rack construction. Although the dishwasher rack 30, 40 may be a middle rack as shown in the one embodiment, the rack 30 with basket 20, if used, may be used in one or more rack positions of the dish washing appliance.

In use, the racks 30 and 40 may be moved relative to each other and/or together to load/unload and wash the utensils (e.g. stow and/or deploy). The rack 30 (e.g. with silverware basket 20 if used) may be deployed or stowed relative to the rack 40, when the rack 40 is in the stowed position and/or the deployed position. As such, the rack 30 and/or basket 20 may be actuated from the rack 40. Moreover, when the rack 40 is deployed or pulled out and/or stowed or pushed in, the rack 30 and/or basket 20 may be carried or travel with the rack 40. Moreover for example, in use, the user may deploy the rack 30 first and upon reaching a deployed position (e.g. See FIG. 2), the rack 40 may be subsequently deployed or pulled from its stowed position towards a deployed position. Alternatively, a deployed rack 30 may be pushed or returned towards its stowed position with the rack 40 (e.g. in its deployed position) and the user may subsequently continue to push the rack 30, stowed with rack 40, towards the racks 40 stowed position within the tub 14. A retention device, if used, (e.g. one or more indentation engagements) may releasably fix the position of the one or more racks 30, 40 in one or more positions (e.g. stowed and/or deployed position).

The one or more racks 30, 40 or baskets 20, 120 may include one or more slide mechanisms 50 allowing the rack or portions thereof to move between positions (e.g. stowed and deployed positions). The dishwasher racks 30, 40 are pulled out and pushed back into place within the dishwasher tub, with the rack riding/sliding on the one or more slide mechanisms 50 (e.g. rollers, wheels, glides/slides, or rails). Although shown as manually driven, occasionally, these racks may be motorized to translate the movement of the dishwasher rack. In the one embodiment shown, one or more slide mechanisms 50 (e.g. first slide mechanisms) connect the rack 40 to the dishwasher tub (e.g. one or more sidewalls, top wall, bottom wall, etc.). The first slide mechanism 50 positions the rack 40, with the carried rack 30, between at least one stowed position and at least one deployed position relative to the remaining portion of the dish washing appliance. One or more additional slide mechanisms 50 (e.g. second slide mechanisms) connect the rack 30 and/or basket 20 to the rack 40. The second slide mechanism positions the rack 30 and/or basket 20 between at least one stowed position and at least one deployed position relative to the rack 40 and/or dishwasher tub 14. The first slide mechanism 50 and the second slide mechanism 50 may be similar or different in various embodiments. In the one embodiment shown, the first and second slide mechanisms 50 may be the same (e.g. one or more slides 52). Although, the first and second slide mechanisms 50 (e.g. rails, slides, rollers) and the racks/baskets may extend and travel in the same direction between the deployed and stowed positions in some embodiments as shown, it should be understood that the directions of travel and the planes traveled within may be different.

The one or more slides or slide mechanisms 50 may be a variety of shapes, sizes, quantities, constructions, and positions with the racks and other portions of the dish washing appliance and still be within the scope of the invention. For example, in the one embodiment shown, the one or more second slides 52 or slide mechanisms 50 may be on the same sidewall of the rack 30 and engage the interior wall 45 spaced inwardly from the outer periphery 41 or sidewall 44 of the rack 40. In some embodiments, two opposing sidewalls of the rack 30 may include the slides 52 and engage the outer periphery 41 or sidewall 44 of the rack 40 and the interior wall 45. In various embodiments, for example, the second slides 52 may be positioned beneath or on a bottom side of the rack 30 and connect to a bottom side 46 of the rack 40. In the one embodiment shown, the first slide mechanism 50 (e.g. slides 52, rollers, etc.) may be positioned on or adjacent the opposing sidewalls 44 of the rack 40 and engage to the interior of the dishwasher tub 14.

Figure 6:
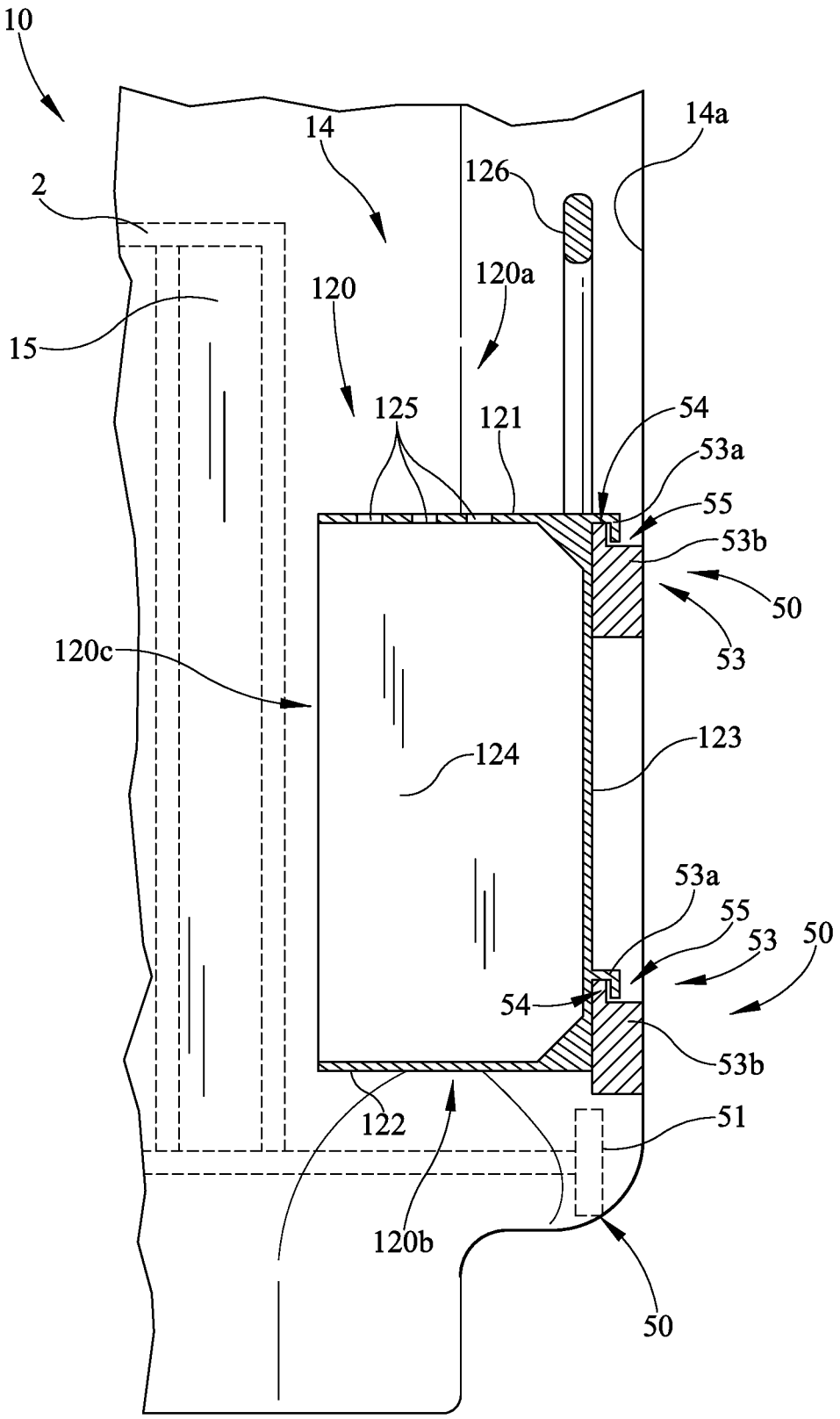
FIG. 6 is a sectional view of the dish washing appliance of FIG. 4 with the basket/rack in the stowed position.

In addition, in some embodiments as shown in FIGS. 4-6, the one or more baskets 120 may be connected or slidingly engaged to the interior (e.g. sidewall) of the dishwasher tub 14 and be positioned between the stowed and deployed position. The basket 120 may move independently of the one or more dishwasher racks 2, 3, 30, 40 positioned in the dishwasher tub 14. The racks 2, 3, 40 may be connected or slidingly engaged (e.g. one or more slide mechanisms) to the dishwasher tub 14 separate from the basket 120. The basket 120 is shown as removable or removably mounted to the dishwasher tub 14 in the one embodiment shown in FIG. 5. Alternatively, the basket 120 may be fixed to the interior of the dishwasher tub 14 (e.g. sidewall) and not be removable.

In the one embodiment shown in FIGS. 4-6, one or more baskets 120 engages the dishwasher tub 14. The basket 120 engages a sidewall 14*a* of the dishwasher tub 14 and is positioned between the stowed position (FIGS. 4 and 6) and the deployed position (FIG. 5). One or more slide mechanisms 50 (e.g. slides) may be used between the basket 120 and the dishwasher tub 14 (e.g. sidewall). The dishwasher tub 14 may have multiple locations, with one or more slide mechanisms 50, to position the basket 120 relative to the dishwasher tub 14. For example, although the slide mechanism 50/basket 120 is attached to one sidewall 14*a* of the dishwasher tub 14, the other opposing sidewall 14*a* may include another slide mechanism 50 and/or basket 120. In some embodiments, a single basket 120 may be used between a plurality of locations or slide mechanisms 50, or portions thereof, within the dishwasher tub. For example, the basket 120 could be positioned on the other opposing sidewall 14*a* or another slide mechanism 50 in some embodiments. Moreover, the basket 120 may be removed for different wash cycles if desired by the user.

Although the basket 120 may be a silverware basket in the one embodiment shown, it should be understood that the basket may be a variety of constructions, shapes, sizes, and quantities for receipt of a variety of articles, including but is not limited to silverware, and still be within the scope of the invention. In the one embodiment shown of basket 120 includes a top wall 121 opposite a bottom wall 122 and interconnected by a rear wall 123. The top wall 121 may be adjacent a top end 120*a* and the bottom wall 122 may be adjacent a bottom end 120*b* opposite the top end. The rear wall 123 may include a portion of or be adjacent the slide mechanism 50 and/or interior of the dishwasher tub 14 (e.g. sidewall 14*a*). One or more dividing walls 124, if used, may extend between the top wall 121, bottom wall 122, and/or rear wall 123 to define one or more compartments. The top wall 121, if used, may include one or more apertures 125 to receive utensils (e.g. silverware). The basket or one or more ends thereof (e.g. top wall, bottom wall, rear wall, etc.) may also define an open front wall 120*c*, opposite to the rear wall 123, and open opposing ends 120*d*, 120*e*. The one or more open sides, ends, or walls (e.g. open front wall 120*c*, open ends 120*d*, 120*e*, etc.) may allow fluid (e.g. wash/rinse) to enter into the basket 120 to engage the utensils therein. This may increase wash or fluid communication within the basket. It should be understood that the top wall may be open in some embodiments.

In some implementations, the basket 20, 120 may include one or more handles 126. As shown in FIG. 5, the handle 126 may assist the user in removing the basket 120 from the dishwasher tub 14 (e.g. sidewall) and/or slide mechanism 50 or portions thereof. The user may remove the basket 120 upwardly and away (e.g. lifting) from the slide mechanism 50. As shown in the one embodiment, the one or more handles 126 may project upwardly from the top wall 121. The handle 126 may be adjacent the rear wall 123, disposed over the slide mechanism 50, and/or adjacent the sidewall 14*a* of the dishwasher tub 14. This position of the handle 126, adjacent the rear wall 123/sidewall 14*a* may reduce interference with fluid engaging the utensils. Although the handle 126 is shown as fixed, in some embodiments the handle may be repositionable and/or removable. For example, the handle may pivot or be foldable between positions.

In some embodiments, the basket 120 may include one or more pull members or a second handle 127 to allow the user to move the basket between the stowed position and the deployed position. The pull member 127 may assist the user to position the basket from the stowed position to the deployed position. In the one embodiment shown, the pull member or tab 127 may be adjacent the front end 120*d* of the basket 120 or tub opening 13. The tab 127 may project into the open end 120*d* of the basket. The user may be able to slide (e.g. push and/or pull) the basket in and out of positions by engaging the tab.

In some implementations, the basket 120 may include the one or more slide mechanisms 50, or portions thereof, to slidably engage the dishwasher tub 14 (e.g. sidewall 14*a*). The slide mechanism or sliding engagement 50 may be a variety of constructions, shapes, sizes, quantities, and positions engaging the basket 120 with the sidewall 14*a* of the dishwasher tub 14. For example, the slide mechanism 50 may be rollers, wheels, glides/slides, or rails. In the one embodiment shown in FIGS. 4-6, the slide mechanisms 50 may be one or more rail engagements 53 allowing the relative sliding between positions. The basket 120 may include one or more rails 53*a* and the sidewall 41*a* may include one or more corresponding rails 53*b* in the sliding engagement 50. The rails 53*b* may be elongated and project inwardly from the sidewall 14*a* of the dishwasher tub 14 in a direction from the tub opening 13 towards the rear wall of the tub 15. The rear wall 123 of the basket 120 may include the one or more rails 53*a* projecting therefrom. The one or more rails 53*a* of the basket 120 may extend between the open opposing ends or opposing ends 120*d, e* (e.g. front side and back side) of the basket 120. In the one embodiment shown, the rails 53*a* of the basket 120 may be an elongated slot or notch 54 (e.g. inverted) to receive the one or rails 53*b* of the dishwasher tub 14 or appliance. The elongated slot of the rail 53*a* may extend between the opening opposing ends, or front end 120*d* towards the back end 120*e*. In various embodiments, the rails 53*b* may be an elongated slot or notch 55 (e.g. opposite orientation to slot 54) slidably engaging the rail 53*a* of the basket 120.

The basket 120 (e.g. silverware basket) may be positioned in a variety of locations relative to the one or more racks 2, 3, 40 and still engage the sidewall 14*a* of the dishwasher tub 14. In the one embodiment shown, the basket 120 and at least one wire rack 2 are laterally positioned relative to each other in a horizontal plane. The basket 120 and the laterally positioned or bottom rack 2 may separately slide in the same direction within the horizontal plane in some embodiments as shown. It should be understood that the basket 120 or portions thereof may overlap, vertically and/or horizontally, an adjacent rack as shown more clearly in FIG. 6. In some embodiments, for example, the basket 120 may not vertically and/or horizontally overlap one or more racks.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. A dishwasher rack for a dish washing appliance comprising:

a first wire rack is positionable in a first stowed position in the dish washing appliance, and wherein the first wire rack includes a front side and an opposing back side, a first sidewall and an opposing second sidewall, and an interior wall disposed between the first sidewall and the second sidewall, wherein the interior wall is spaced inwardly from the first sidewall and extends from the front side to the back side, wherein each one of the back side, the first sidewall, the second sidewall, and the interior wall includes a top edge, wherein the top edge of the interior wall and the first sidewall is at a higher elevation than the top edge of the second sidewall when the first wire rack is horizontally level, wherein the first wire rack includes a portion of the front side between the interior wall and the first sidewall having a discontinuous top edge defining a fixed opening;

a second wire rack disposed in the first wire rack in a second stowed position, wherein when in the second stowed position the second wire rack is positioned in the portion of the front side having the discontinuous top edge; and a slide mechanism connecting the second wire rack to the first wire rack, wherein the slide mechanism is positioned only on the interior wall and allows the second wire rack to translate horizontally through the fixed opening from the second stowed position with the first wire rack outwardly and away from the portion of the front side having the discontinuous top edge.

2. The dishwasher rack of claim 1 wherein the first wire rack includes a second slide mechanism.

3. The dishwasher rack of claim 1 further comprising a silverware basket removably mounted in the second wire rack.

4. The dishwasher rack of claim 1 wherein the second wire rack includes a second deployed position different from the second stowed position, wherein the second wire rack is in the second deployed position in at least the first stowed position of the first wire rack.

5. The dishwasher rack of claim 1 wherein when in the second stowed position, the second wire rack is disposed within an outer periphery of the first wire rack.

6. The dishwasher rack of claim 5 wherein when in the second stowed position, the second wire rack extends from the front side to the back side of the first wire rack.

7. The dishwasher rack of claim 6 wherein the second wire rack passes through the front side of the first wire rack when moving away from the second stowed position.

8. The dishwasher rack of claim 1 wherein the slide mechanism includes one or more slides.

9. The dishwasher rack of claim 1 wherein the first wire rack includes a shallow portion and a deep portion, wherein the second wire rack is disposed in the shallow portion of the first wire rack.

10. The dishwasher rack of claim 1 wherein the interior wall and the first sidewall define an upper portion of the first wire rack at a higher elevation than a remaining portion of the first wire rack.

11. The dishwasher rack of claim 1 wherein a top edge of the second wire rack is offset below the discontinuous top edge defining the fixed opening.

12. A dish washing appliance comprising:

a dishwasher tub;

a first rack having a front side and an opposing back side, a first sidewall and an opposing second sidewall, and an interior wall disposed between the first sidewall and the second sidewall, wherein the interior wall is spaced inwardly from the first sidewall and extends from the front side to the back side, wherein each one of the back side, the first sidewall, the second sidewall, and the interior wall includes a top edge, wherein the top edge of the interior wall and the first sidewall is at a higher elevation than the top edge of the second sidewall when the first rack is horizontally level, wherein the first rack is positionable between a first stowed position in the dishwasher tub and a first deployed position, wherein the first deployed position is different from the first stowed position;

a second rack positioned between the interior wall and the first sidewall is carried with the first rack between the first stowed position and the first deployed position, wherein the second rack is spaced away from and below the top edge of the front side and the interior wall of the first rack, and wherein there is no outer periphery portion between the interior wall and the first sidewall of the front side at an elevation above the second rack; and a slide mechanism connecting the second rack to the first rack, wherein the slide mechanism is positioned only on the interior wall, wherein the second rack is positionable horizontally between a second stowed position in the first rack and a second deployed position, wherein when in the second deployed position the second rack projects outwardly and away from the front side of the first rack.

13. The dish washing appliance of claim 12 wherein the second rack projects from the front side of the first rack when the second rack is in the second deployed position.

14. The dish washing appliance of claim 12 wherein when the first rack is in at least the first stowed position, the second rack is in the second deployed position.

15. The dish washing appliance of claim 12 when the first rack is in at least the first deployed position, the second rack is in the second deployed position relative to the first rack.

16. The dish washing appliance of claim 12 further comprising a second slide mechanism connecting the first rack and the dishwasher tub.

17. The dish washing appliance of claim 16 wherein the first rack travels in a first direction between the first stowed position and the first deployed position and the second rack travels in a second direction between the second stowed position and the second deployed position, and the first direction is the same as the second direction.

18. The dish washing appliance of claim 12 wherein the first rack is a middle rack positioned between an upper rack and a lower rack.

19. The dish washing appliance of claim 12 wherein the first rack includes a bottom side having a lower portion and an upper portion disposed at different elevations to define deep and shallow portions of the first rack, the shallow portion includes the second rack.

20. The dish washing appliance of claim 12 wherein the slide mechanism includes an upper slide and a lower slide positioned at a lower elevation than the upper slide.

* * * * *